US005931127A

United States Patent [19]

Buck et al.

[11] Patent Number: 5,931,127

[45] Date of Patent: Aug. 3, 1999

[54] VARIABLE VALVE TIMING MECHANISM FOR AN INTERNAL COMBUSTION ENGINE

[75] Inventors: Walter Buck, Ludwigsburg; Michael Kuhn, Ebersbach; Roland Schwegler, Weinstadt, all of Germany

[73] Assignee: Daimler-Benz-A.G., Stuttgart, Germany

[21] Appl. No.: 09/007,563

[22] Filed: Jan. 15, 1998

[30] Foreign Application Priority Data

Jan. 15, 1997 [DE] Germany ..... 197 01 202

[51] Int. Cl.[6] ..... F01L 1/04; F01L 13/00

[52] U.S. Cl. ..... 123/90.17; 123/90.31

[58] Field of Search ..... 123/90.15, 90.17, 123/90.31

[56] References Cited

U.S. PATENT DOCUMENTS

| | | | |
|---|---|---|---|
| 4,993,370 | 2/1991 | Hashiyama et al. | 123/90.17 |
| 5,152,262 | 10/1992 | Parker | 123/90.17 |
| 5,531,193 | 7/1996 | Nakamura | 123/90.17 |
| 5,555,860 | 9/1996 | Wride | 123/90.17 |
| 5,586,527 | 12/1996 | Kreuter | 123/90.17 |
| 5,592,906 | 1/1997 | Kreuter et al. | 123/90.17 |

FOREIGN PATENT DOCUMENTS

| | | |
|---|---|---|
| 0 440 314 | 8/1991 | European Pat. Off. . |
| 490 848 | 2/1930 | Germany . |
| 91 02 090 | 6/1991 | Germany . |
| 41 39 446 | 6/1992 | Germany . |
| 42 44 550 | 7/1994 | Germany . |

*Primary Examiner*—Weilun Lo
*Attorney, Agent, or Firm*—Klaus J. Bach

[57] ABSTRACT

In a variable valve timing mechanism for an internal combustion engine with exhaust valves operated by an exhaust camshaft and intake valves operated by two intake camshafts of which one is driven by the exhaust camshaft by way of a phase controller disposed at one end of one of the intake camshafts and controls the valve openings time and the other is driven by the one intake camshaft by way of a coupler drive which is disposed at the opposite end of the one intake camshaft and controls the valve closing times.

3 Claims, 2 Drawing Sheets

VARIABLE VALVE TIMING MECHANISM FOR AN INTERNAL COMBUSTION ENGINE

BACKGROUND OF THE INVENTION

The invention relates to a variable valve timing mechanism for an internal combustion engine with at least one camshaft for operating exhaust valves and two camshafts rotating in opposite directions and actuating, by way of rocker arms, inlet valves which are spring biased in a closing direction, wherein one of the inlet valve camshafts controls the valve opening process and the other controls the valve closing process such that, by changing the relative rotation of the two inlet valve camshafts, the opening duration of the inlet valves can be controlled.

Such variable valve timing mechanisms are known for example from DE 42 44 550 A1, FIG. 5. In the arrangement shown therein, the angular position of the two intake camshafts relative to the crankshaft is adjustable by a special control mechanism. The angular position of one of the intake camshafts is adjustable by a phase control mechanism operating with the axial displacement of a transmission member which adjusts the angular position of the camshaft, whereas the control mechanism for the other camshaft includes a four-wheel coupler drive linkage. The two control mechanisms are adjustable by way of a common control member, that is, the coupler of the coupler linkage, such that they are adjustable in certain relationship with one another. This arrangement is relatively complicated and requires a high mechanical expenditure in order to realize the desired control accuracy. Still, inspite of the high mechanical expenditure, the adjustment possibilities are quite limited because the camshafts cannot be controlled independently.

It is the object of the present invention to provide better solution for a variable valve timing mechanism.

SUMMARY OF THE INVENTION

In a variable valve timing mechanism for an internal combustion engine with exhaust valves operated by an exhaust camshaft and intake valves operated by two intake camshafts of which one is driven by the exhaust camshaft by way of a phase controller disposed at one end of the intake camshaft and controls the valve opening times and the other is driven by the one intake camshaft by way of a coupler drive which is disposed at the opposite end of the one intake camshaft and controls the valve closing times.

With such an arrangement, the phase controller provides for a basic adjustment of both intake valve camshafts. In addition, one of the camshafts can be adjusted relative to the other by way of the coupler drive linkage depending on the adjustment movement of the coupler providing for a superimposed adjustment movement in one or the opposite sense. In this way, wide adjustment possibilities are obtained which, in combination with a corresponding control, which is preferably part of the engine management system, permits to control valve lift as well as the valve opening phase angle so as to change the valve timing from early to late and vice versa.

As phase controller well known mechanical or hydraulic phase controllers can be utilized. Also, a coupler drive such as the one described in DE 4 244 550 A1, FIG. 1 may be utilized which provides for a particularly large adjustment range.

Within the scope of the invention, it is advantageous if the camshaft responsible for the intake opening function is activated directly by the phase controller, whereas the second camshaft responsible for the valve closing function is driven by the first camshaft by way of the coupler drive.

Below, the invention will be described on the basis of the drawings showing the invention schematically.

DESCRIPTION OF A PREFERRED EMBODIMENT

Figure 1:
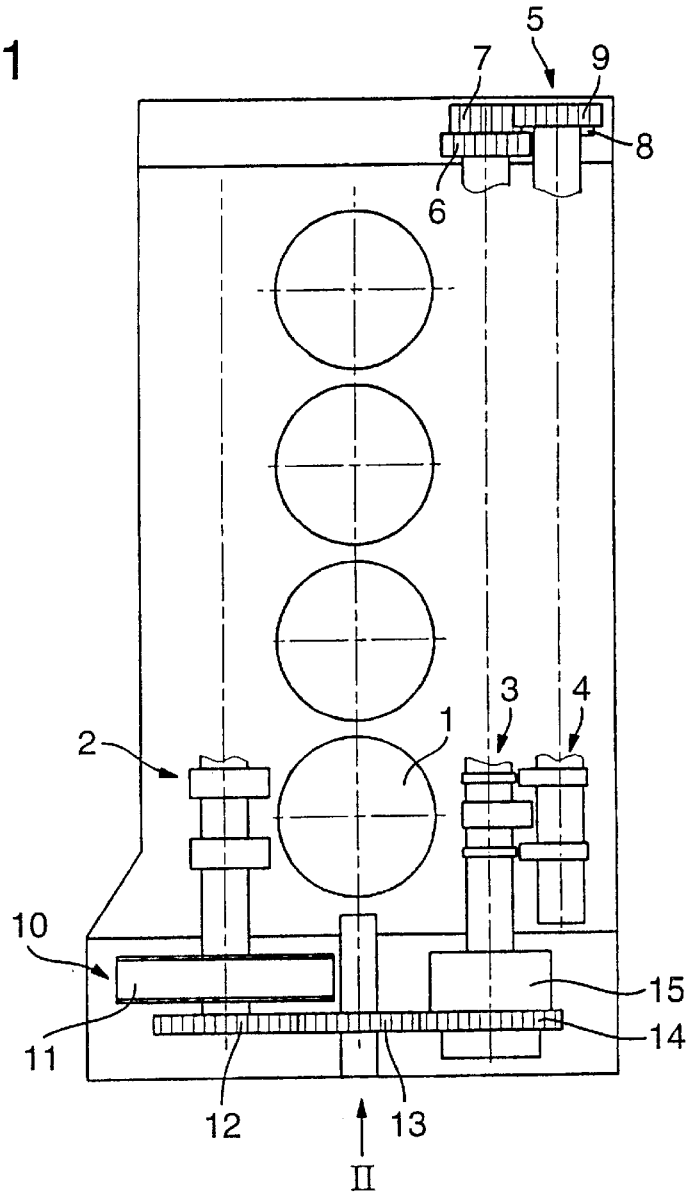
FIG. 1 is a top view of a four cylinder internal combustion engine with one exhaust and two intake camshafts.

As shown in FIG. 1, the internal combustion engine includes four cylinders 1 arranged in-line and is provided with one exhaust camshaft 2 and two intake camshafts 3 and 4 for actuating the valves of the engine which are not shown in the drawings. The exhaust camshaft is disposed at one side of the centerline of the row of cylinders and the intake camshafts are disposed at the other side of the centerline of the row of cylinders. The valves are actuated by the camshafts in the usual manner, wherein the intake camshafts 3 and 4 operate together with the rocker arms (not shown) of the intake valves in such a way that the intake camshaft 3 controls the opening and the intake camshaft 4 controls the closing of the intake valves. In order to obtain the desired variability of the valve timing mechanism, the two intake camshafts 3 and 4 are driven by way of a four-wheel coupler drive as it is disclosed in detail in DE 42 44 455 A1. The coupler drive which is indicated, as a whole, by numeral 5 (FIG. 2) comprises a drive gear 6 mounted on the intake camshaft 3. The drive gear 6 of the intake camshaft 3 controls the opening of the inlet valve and the driven gear 9 of the intake camshaft 4 controls the closing of the intake valves.

Figure 3:
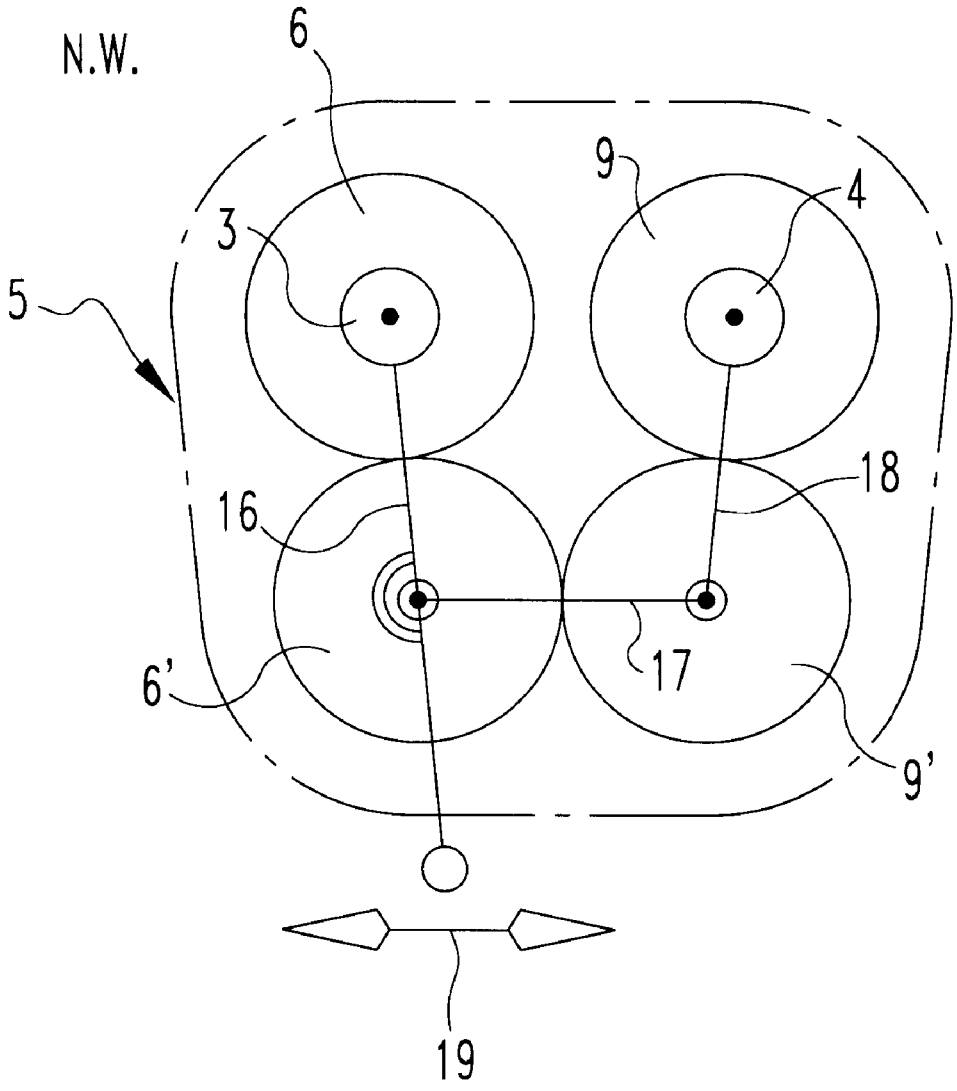
FIG. 3 shows schematically a coupler drive.

A coupler drive 5 is shown schematically in FIG. 3. The drive gear 6 and the driven gear 9 are in engagement with each other by way of intermediate gears 6' and 9'. The drive gear 6 is held in engagement with the first intermediate gear 6' by a first coupling link 16; the first intermediate gear 6' is held in driving engagement with the second intermediate gear 9' by a second coupling link 17. The second intermediate gear 9' is held in driving engagement with the driven gear 9 by a third coupling link 18 so that the intake camshaft 4 rotates in a direction opposite to that in which the intake camshaft 3 rotates.

The coupling link 16 can be pivoted as indicated by the arrow 19. Upon pivoting of the coupling link 16 about the axis of the camshaft 3, the gear 9 and the camshaft 4 connected thereto are rotated, with the superimposed movement of the pivoting angle, by the rolling of the gears on one another with respect to the camshaft 3 such that the relative angular positions of the intake camshafts 3 and 4 depend on the pivot position of the coupling link 16.

Figure 2:
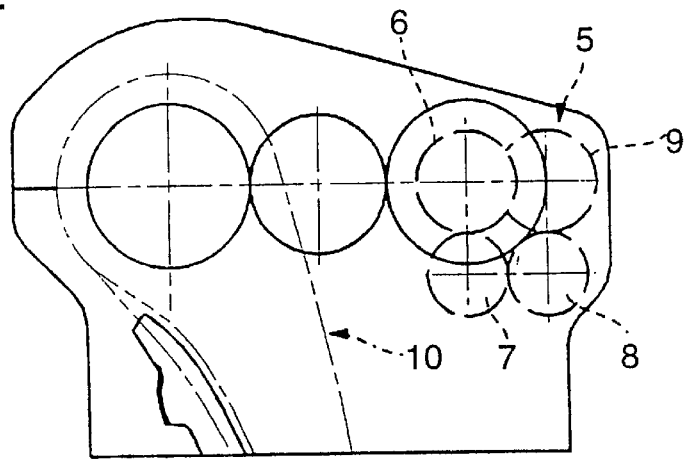
FIG. 2 is a front view of the cylinderhead as seen in the direction of the arrow II given in FIG. 1.

The coupler drive 5 is disposed at the rear end of the internal combustion engine when seen in accordance with FIG. 2 in the direction of the arrow II. At the front end of the engine, the drive 10 for the exhaust camshaft 2 is disposed which is a chain drive operated by the crankshaft of the engine in the usual manner. The chain drive 10 includes a chain gear 11 mounted on the camshaft 2.

Also mounted on the camshaft 2 adjacent the chain gear 11 is a gear 12 which, by way of an intermediate gear 13, drives another gear 14 disposed on the intake camshaft 3.

The gears 12, 13 and 14 form the drive for the first intake camshaft 3 which consequently is also driven by the exhaust camshaft 2 and the camshaft 3 drives the second intake camshaft 4 by way of the coupler drive 5. The gear 14 is mounted on the intake camshaft 3 by way of a phase controller 15, which as such, is well known in the art and via which the intake camshaft 3 can be rotated relative to the exhaust camshaft so that the phase of the intake camshaft can be changed relative to the exhaust camshaft or, respectively, the camshaft of the engine. As a result, the intake camshaft 3 timing phase relative to that of the exhaust camshaft 2 can be changed independently of the momentary setting of the coupler drive 5. If the phase position of the intake camshaft 3 relative to the exhaust camshaft 2, or respectively the crankshaft, is changed by the phase controller 15 such that the intake camshaft 3 is for example advanced in its direction of rotation, also the intake camshaft 4 is advanced in its direction of rotation.

On this phase position control action, an additional adjustment movement in the same or the opposite direction can be superimposed on the camshaft 4 by adjustment of the coupler drive 5 so that a wide adjustment range is provided. Instead of the phase controller 15, a coupler drive like the coupler drive 5 could be used for the phase control of the intake camshaft 3. Such a coupler drive could be so designed and arranged that, in addition to providing for a phase control, it could form the drive connection between the exhaust camshaft 2 and the intake camshaft 3. Of course, the larger the adjustment ranges, the greater are the possible timing variations in the valve timing mechanism.

What is claimed is:

1. A variable valve timing mechanism for an internal combustion engine including an exhaust camshaft for operating exhaust valves, two intake camshafts rotating in opposite directions for actuating intake valves which are spring biased in a closing direction, one of said intake camshafts controlling the opening of said intake valves and the other of said intake camshafts controlling the closing of said intake valves, a phase controller arranged at one end of said one intake camshaft and being drivingly connected to said exhaust camshaft for rotation therewith in such a way that the angular position of said one intake camshaft relative to that of said exhaust camshaft can be changed, and a coupler drive with a driving gear disposed at the other end of said one intake camshaft and being drivingly connected to said other intake camshaft such that a rotational phase displacement between said intake camshafts can be achieved for changing the timing of said intake valves.

2. A valve timing mechanism according to claim 1, wherein said phase controller and said driving gear of said coupler drive are disposed on said one intake camshaft which controls the intake valve opening times.

3. A valve timing mechanism according to claim 1, wherein said other intake camshaft, which is driven by said coupler drive, determines the intake valve closing times.

* * * * *